United States Patent [19]

Langley et al.

[11] 4,305,781

[45] Dec. 15, 1981

[54] PRODUCTION OF NEWPRINT, KRAFT OR FLUTING MEDIUM

[75] Inventors: John G. Langley, Baildon; Edward Litchfield, Bury, both of England

[73] Assignee: Allied Colloids Limited, Bradford, England

[21] Appl. No.: 129,782

[22] Filed: Mar. 12, 1980

[30] Foreign Application Priority Data

Mar. 28, 1979 [GB] United Kingdom ..... 10828/79

[51] Int. Cl.[3] ..... D21H 3/38

[52] U.S. Cl. ..... 162/164 R; 162/168 NA; 162/181 D

[58] Field of Search ..... 162/164 R, 168 NA, 181 D

[56] References Cited

U.S. PATENT DOCUMENTS 2,368,635 2/1945 Booth ..... 162/181 C
3,052,595 9/1962 Pye ..... 162/164 R

FOREIGN PATENT DOCUMENTS 618235 4/1961 Canada ..... 162/168 NA
804504 11/1958 United Kingdom .
883973 12/1961 United Kingdom ..... 162/168 NA
1025558 4/1966 United Kingdom .

OTHER PUBLICATIONS

Tappi, vol. 63, No. 6, pp. 63–66, Jun. 1980.
Tappi, vol. 45, #4, Apr. 1962, pp. 326–333.
Pelton et al., Pulp & Paper Canada, vol. 81, No. 1, Jan. 1980, pp. 54–62.
Schwalbe, Pulp and Paper Science and Technology, vol. 2, 1962, p. 60, McGraw-Hill.
Tappi, vol. 56, No. 10, Oct. 1973, pp. 46–50.
Chemical Abstracts, vol. 82, 1975, p. 174, 60345u.

*Primary Examiner*—William F. Smith
*Attorney, Agent, or Firm*—Lawrence Rosen

[57] ABSTRACT

The drainage and retention properties of an aqueous cellulosic suspension substantially free of filler and which is being used for the production of paper or paper board are improved by including a water soluble high molecular weight substantially non-ionic polymer and a bentonite-type clay.

5 Claims, No Drawings

PRODUCTION OF NEWPRINT, KRAFT OR FLUTING MEDIUM

Many grades of paper include substantial levels of inorganic fillers such as kaolinite, calcium carbonate and titanium dioxide. For instance good quality paper, often referred to as fine paper, may be made from high grade bleached chemical pulp and may contain 5 to 35%, by weight of dry paper, of inorganic filler. In the production of such papers it is common to use retention aids and drainage aids. The cost of these is more than offset by the increased retention of filler in the sheet and by the reduction of filler in the white water and the subsequent loss in effluent discharge, especially in view of increasing costs of raw materials and pressure from environmental legislation to restrict effluent discharge.

A variety of retention and drainage aids are known such as polyacrylamides (PAM), polyethyleneimines (PEI), polyamides and polyamines.

In U.S. Pat. No. 3,052,595 the use of polyacrylamides with filler is particularly described and it is stated that advantageous results are obtained when bentonite provides 1 to 20% by weight of the mineral filler. In British Pat. No. 1,265,496 it is described how polyacrylamides are used to retain inorganic filler and cellulosic fines but that critical conditions have to be observed for successful operation, and particular modified acrylamides are described.

Retention and drainage aids are generally used at levels of 100 to 500 grams/tonne of dry polymer on a dry paper weight. At these amounts cost effective advantages can easily be demonstrated in the production of filled or fine papers.

There is, however, very large scale production of paper that is substantially unfilled, for instance as newsprint, kraft and fluting medium, for instance in the production of board. The unfilled paper is substantially free of filler, generally containing less than 5%, by weight of dry paper, of filler and often there is no deliberate addition of filler to the pulp from which the paper or board is made. Generally the pulp for the newsprint, kraft and fluting medium originates from Canada or Scandinavia and is of low grade fibres. With such pulps it would still be desirable to minimise the wastage of the components of the pulp, i.e. to improve retention of pulp components in the paper, but it is not so easy to demonstrate cost effective advantages by using the known retention and drainage aids for this purpose since the pulps have a high cationic demand. The cationic demand is the amount of cationic polymer that has to be added to give any significant increase in fibre retention and improvement in drainage on the forming wire. The cationic demand is often above 0.1% so that improvements are only significant with polymer weights of above 1,000 grams dry polymer per tonne dry weight of paper and such amounts render the treatment uneconomic.

The papermaking fibres used in Canada and Scandinavia for newsprint, fluting medium and kraft are low grade fibres and are predominantly of the mechanical type and include groundwood, thermomechanical pulp, deinked secondary fibres, semi-chemical pulps and semi-bleached chemical kraft pulps, normally produced in situ in an integrated pulp and paper mill system. The cellulosic fibres are thus rarely completely separated from the residual process liquors which contain substantial levels of both organic and inorganic impurities derived from the pulping process itself and the resins naturally present in the wood.

These impurities are present in solution and in colloidal suspension and may include such substances as lignosulphonates, rosin acids, hemicelluloses and humic acids, and impart a large negative charge on the cellulose fibres when dispersed in water as typical in the papermaking process. The level of the aforementioned impurities is further enhanced in the papermaking process by the increasing tendency for paper mills to "close-up" the paper machine white water systems and re-cycle as much white water as possible.

Thus there is a need for fibre retention drainage aids which traditional aids cannot meet and so there has been extensive research into the development of new aids, but so far with limited success.

In German Pat. No. 2262906 it is proposed to improve the dewatering of cellulosic slurries by adding bentonite and a low molecular weight cationic polymer that serves as a polyelectrolyte. The results are not satisfactory and this specification does not give a solution to the problem of cost effective improvement in fibre retention and drainage of substantially filler free, low grade pulp.

It has now surprisingly been found that if the polymer is a high molecular weight substantially non-ionic polymer then dramatic improvement in dewatering properties and fibre retention is obtained in substantially filler free cellulose suspensions if a deliberate addition of a particular filler, namely bentonite type clay, is made to the suspension.

Thus the invention relates to processes in which paper or paper board is made from an aqueous suspension of cellulose fibres and is characterised in that the suspension and the paper or paper board are substantially free of filler and the drainage and retention properties of the suspension are improved by including in the suspension a water soluble, high molecular weight, substantially non-ionic polymer and a bentonite type clay.

The suspension may be made from pulp by normal techniques and the paper or paper board may be made from the aqueous suspension also by normal techniques.

Throughout this specification, unless otherwise stated all percentages are given as dry weight of added material calculated on the dry weight of the suspension or final paper.

The suspension and the resultant paper or paper board are substantially free of filler and the total amount of filler, including added bentonite type clay, is generally less than 5% by weight. It is generally preferred that no inorganic filler other than bentonite type clay should be included in the suspension but if any such filler is included its amount is generally less than 3% and most preferably below 2%, in particular below 1.5%. If there is any filler other than bentonite the amount of additional filler is often less than twice the amount of bentonite and is preferably less than the amount of bentonite. If additional filler is included in the suspension it is usually a conventional predried filler, such as any of the materials listed in U.S. Pat. No. 3,052,595.

The amount of bentonite included in the pulp is generally between 0.02 and 2% by weight dry bentonite-type clay, based on dry weight of paper or pulp, and most preferably is from 0.1 to 1%.

The bentonite-type clay used in the invention may be one of the common commercially available bentonites (known as montmorillonite clays), such as "Wyoming bentonite" and "Fullers Earth", and may or may not be chemically modified, e.g. by alkali treatment to convert clacium bentonite substantially to alkali (e.g. sodium, potassium or ammonium)bentonite.

Bentonites having the property of swelling in water are preferred.

The polymers used in the invention must be high molecular weight, that is to say they must have a molecular weight that is above 100,000 and is such as to give a bridging effect. The molecular weight will normally be above 500,000, generally being about or above 1 million.

The polymers must be substantially non-ionic and thus may be wholly non-ionic or they may have small amounts of anionic or cationic units. Generally the polymer will contain not more than 10 mole percent anionic units and not more than 10 mole percent cationic units although it both types of groups are present the molar amounts of each type may be higher than quoted above provided the molar amount of one ionic type in the polymer is not more than 10., and preferably not more than 5%, above the molar amount of the other ionic type. If cationic units are present the amount is generally less than 5 mole percent but preferably the polymer is free of cationic units.

Preferred polymers are polyacrylamides containing up to 10 mole percent anionic units, generally acrylic acid units. For example preferred polymers contain 1 to 8 mole percent acrylic acid with the balance acrylamide, most preferably 97 mole percent acrylamide, 3% acrylic acid, often as sodium acrylate.

Other comonomers that may be included, especially in polyacrylamides, include dialkyl amino alkyl acrylates and methacrylates quanternised with for instance dimethyl sulphate or alkyl halides, for instance quaternised dimethyl amino ethyl acrylate or methacrylate, methacrylic acid, sodium methacrylate, diallyl dimethyl ammonium chloride. Methacrylamide may be used as the main monomer instead of some or all of the acrylamide. The preferred copolymers of acrylamide and acrylic acid (or sodium acrylate) can be made by hydrolysis of the homopolymer either during or after its initial synthesis.

Other suitable non-ionic polymers for use in the invention include polyethylene oxide.

It is easily possible, by routine experimentation, to select preferred combinations of polymers and bentonite grades. It has surprisingly been found that it is easily possible to obtain excellent retention and drainage results using polymer-bentonite combinations whereas the bentonite alone on the same pulp or the polymer alone on the same pulp give worse results than with the pulp alone. Thus there is a surprising synergistic effect between the bentonite and the polymer.

The amount of polymer added is generally at least 50 but generally less than 1,000 grams dry polymer per ton dry paper (i.e. 0.005 to 0.1%). Generally it is from 0.01 to 0.05%.

The polymer may be supplied as a true solution in water, as a solid grade product or as a dispersion in a carrier oil, but in all cases should be dissolved in water and added as a dilute aqueous solution to the pulp suspension during the papermaking process.

The polymer solution is ideally added after the last point of high shear prior to sheet formation and is typically after centri-screens and just before the flow-box, to ensure good mixing, and to avoid excessive shear which can damage the retention/drainage effect.

The bentonite may be added to the suspension either as a pre-hydrated aqueous slurry directly to thick stock or as a solid to the hydropulper or to the re-circulating white-water providing it is well dispersed during addition to enable adequate hydration and accomplish its characteristic swelling properties.

Preferably traditional additives such as aluminium sulphate or omitted, and preferably the main, and often the only, additives to the pulp in the process of the invention are the described polymer and bentonite, and so the suspension preferably is formed from substantially only cellulosic pulp, water, the polymer, the bentonite-type clay and, optionally, additional filler in the amounts specified above.

The invention is of particular value in the production of kraft paper, fluting medium, for instance in the production of board, and especially in the production of newsprint. It is of particular value in the production of paper or paper board from impure pulps, especially those having a cationic demand (as defined above) of at least 0.1% and often above 1%.

We have also found that the invention gives a surprising and significant improvement in the machine runnability and this enables larger quantities of lower grade fibres to be used without increasing the risk of machine stoppages.

As well as providing improved retention and drainage the method of the invention also results in a significant reduction in the solvent extractable troublesome resinous pitch content of the papermachine white water system. During paper mill trial work a reduction of the extractable pitch content of the white water of 75% was observed.

The invention includes the described method, paper and paper board obtained by it, pulp including bentonite and the polymer, and compositions comprising the bentonite and the polymer.

The following examples illustrate the invention. In these PAM stands for polyacrylamide and all polyacrylamides and polyethylene oxides used have a molecular weight between $10^6$ and $10^7$. PAM 3% SA stands for a copolymer of 97 mole percent acrylamide with 3% mole percent sodium acrylate. In the examples where bentonite was added it was added as a prehydrated aqueous slurry prior to the polymer addition. In none of the examples is aluminium sulphate added and instead in each example the aqueous suspension consisted essentially only of water, cellulosic fibres (and associated impurities from the pulp) and, when appropriate, the added polymer and/or bentonite.

EXAMPLE 1

A sample of thin stock taken from a Swedish newsprint mill consisted of:

30% thermomechanical pulp
25% chemical sulphate pulp
35% groundwood
10% broke

It contained a high level of impurities such as lignosulphates.

The drainage efficiency of various conventional polymers was compared with bentonite-polymer systems according to this invention. The required quantity of dilute polymer solution was added to 1 liter of the stock in measuring cylinder, to give an effective polymer dose level of 0.05% polymer (i.e. 500 g/ton of dry polymer based on the dry weight of paper). The cylinder was inverted three times to effect mixing and the contents were poured onto a typical machine wire. The time taken for 250 mls of white water to drain was noted. The shorter the time the more effective the treatment. The results are given in Table 1.

TABLE 1

| ADDITIVE | Drainage Rate S/250 ml. |
|---|---|
| No polymer addition | 145 secs. |
| Polyamide | 139 secs. |
| Polyethyleneimine | 134 secs. |
| Polyethylene oxide | 68 secs. |
| Polydimethyldiallyl ammonium chloride | 139 secs. |
| Cationic PAM | 126 secs. |
| PAM homopolymer | 109 secs. |
| PAM 3% SA | 91 secs. |
| PAM 10% SA | 148 secs. |
| 0.2% Bentonite + PAM 3% SA | 36 secs. |

EXAMPLE 2

Using the same sample of thin stock as described in Example 1 above, the retention efficiency of various conventional polymers was compared with the bentonite/polymer system according to this invention. The required quantity of dilute polymer solution was added to 1 liter of thin stock in a 1 liter measuring cylinder, to give an effective polymer dose level of 0.05% of dry polymer based on the dry weight of paper. The cylinder was inverted three times to effect mixing and then the contents were poured onto a typical machine wire. The white water draining through the wire was collected and the solids content determined. The lower the solids content the more effective the retention aid treatment. The results are given in Table 2.

TABLE 2

| ADDITIVE | Whitewater Solids ppm. |
|---|---|
| No polymer addition | 1080 |
| Polyethyleneimine | 1130 |
| Polyethyleneoxide | 410 |
| PAM low degree of cationic substitution. | 910 |
| PAM homopolymer | 650 |
| PAM 3% SA | 590 |
| 0.2% Bentonite + PAM 3% SA | 266 |

EXAMPLE 3

On an identical sample of thin stock to that used in Examples 1 and 2, the effect on drainage of varying the level of bentonite addition whilst maintaining a constant dose level of PAM 3% SA was examined. The drainage rate measurements made in the same manner as in Example 1. The shorter the drainage time the more effective the treatment. The results are given in Table 3.

TABLE 3

| Polymer % on dry paper | Bentonite % on dry paper | Drainage Rates S/250 ml. |
|---|---|---|
| 0 | 0 | 93 s |
| 0.04 | 0 | 75 s |
| 0.04 | 0.10 | 60 s |
| 0.04 | 0.20 | 47 s |
| 0.04 | 0.50 | 34 s |
| 0.04 | 1.00 | 21 s |
| 0.04 | 2.00 | 19 s |

EXAMPLE 4

On the same stock sample used in Example 3, the effect on drainage of varying the polymer (PAM 3% SA) addition level whilst maintaining a constant level of bentonite addition, was examined. The drainage rate measurements were made in the same manner as in Example 3. The shorter the drainage rate the more effective the treatment. The results are given in Table 4.

TABLE 4

| Polymer % on dry paper | Bentonite % on dry paper | Drainage Rate S/250 ml. |
|---|---|---|
| 0 | 0 | 93 s |
| 0 | 0.5 | 77 s |
| 0.01 | 0.5 | 65 s |
| 0.02 | 0.5 | 54 s |
| 0.04 | 0.5 | 34 s |
| 0.06 | 0.5 | 17 s |
| 0.08 | 0.5 | 11 s |

EXAMPLE 5

A range of various types of bentonite was evaluated at a constant addition level of 0.5% on dry paper together with a constant dose level of 0.04% on dry paper high molecular weight PAM 3% SA. A sample of the same stock was used as in Examples 3 and 4 and the bentonite/polymer system performance was again assessed by drainage rate measurements. The shorter the drainage time the more effective the treatment. The results are given in Table 5.

TABLE 5

| Bentonite type | Drainage Rate S/250 ml. |
|---|---|
| Natural American sodium montmorillonite | 44 s |
| sodium exchanged English calcium montmorillonite | 25 s |
| sodium montmorillonite Greek origin | 37 s |

EXAMPLE 6

A laboratory stock, substantially free from the undesirable impurities as previously defined, was prepared from a 100% bleached kraft chemical pulp dispersed in deionised water at 2% consistency and beaten in a Valley beater to a freeness of 45° S.R. This stock was further diluted to 1% with deionised water. The drainage efficiency of various polyacrylamides were compared with polyethylene oxide both in the presence and absence of a water swelling bentonite and the results are given in Table 6, which illustrates the truly synergistic effect of the invention.

TABLE 6

| ADDITIVES and amounts as % on dry paper. | Drainage Rate S/250 ml. |
|---|---|
| Stock only - no additives | 99 s |
| 0.04% high mol. wt. PAM 3% SA | 126 s |
| 0.25% bentonite | 117 s |
| 0.04% polyethylene oxide | 86 s |
| 0.25% bentonite + 0.04% anionic PAM | 51 s |
| 0.25% bentonite + 0.04% polyethylene oxide | 67 s |

EXAMPLE 7

Samples of stock were taken from just after the centri-screens in a newsprint mill when additions had been made of bentonite with various polymers, namely acrylamide homopolymer, copolymer with sodium acrylate (anionic PAM) and copolymer with dimethylaminoethyl acrylate quaternised by dimethyl sulphate (cationic PAM). Drainage tests were carried out on a modified Schopper-Reigler freeness tester. With the rear outlet blocking, the time taken for a constant volume of water to drain from 1 liter of stock was recorded. The following results were obtained:

| Additives | | Polymer ionic content (% | Drainage time |
|---|---|---|---|
| Bentonite | Polymer | molar) | (seconds) |
| 0.7% | 0.04% PAM | 0 | 32 |
| 0.7% | 0.04% cationic PAM | 3 | 53 |
| 0.7% | 0.04% cationic PAM | 9 | 69 |
| 0.7% | 0.04% anionic | 3 | 23 |
| 0 | 0 | — | 95 |

We claim:

1. In a method of making newsprint, kraft or fluting medium from an aqueous suspension of cellulosic fibres, the improvement consisting in improving the drainage and retention properties of the suspension are improved by including in the suspension 0.005 to 0.1% dry weight based on the dry weight of the suspension a water soluble, high molecular weight substantially non-ionic polymer selected from the group consisting of polyethylene oxides and polyacrylamides, and 0.02 to 2% dry weight based on the dry weight of the suspension a bentonite-type clay to give an aqueous suspension consisting essentially of pulp, water, said polymer, and fillers; wherein the total amount of filler, including the bentonite-type clay, in the aqueous suspension is less then about 5% by weight based on the dry weight of the suspension; and wherein the aqueous suspension has been formed from pulp having a cationic demand of at least 0.1%; said cationic demand being the amount of cationic polymer that has to be added to give a significant increase in fibre retention and improvement in drainage.

2. A method according to claim 1 in which the amount of bentonite-type clay is 0.1 to 1% and the amount of polymer is 0.01 to 0.05% based on the dry weight of the suspension.

3. A method according to claim 1 in which the polymer is selected from polyacrylamide homopolymer and copolymers of acrylamide with up to 10 mole percent anionic groups.

4. A method according to claim 1 in which the polymer is a copolymer of about 97 mole percent acrylamide and 3 mole percent sodium acrylate.

5. Newsprint, kraft or fluting medium made by a method according to claim 1.

* * * * *